US005813058A

United States Patent [19]

Quigley et al.

[11] Patent Number: 5,813,058

[45] Date of Patent: Sep. 29, 1998

[54] DISSOLVABLE URINAL SCREEN

[75] Inventors: John R. Quigley, Garfield Heights, Ohio; Gary R. Borofsky, Rydal, Pa.

[73] Assignee: The Tranzonic Companies, Pepper Pike, Ohio

[21] Appl. No.: 791,482

[22] Filed: Jan. 27, 1997

[51] Int. Cl.[6] ..... E03F 13/00

[52] U.S. Cl. ..... 4/309; 510/191

[58] Field of Search ..... 4/309; 510/191, 510/192, 193, 440; 424/76.3, 76.7, 196.1

[56] References Cited

U.S. PATENT DOCUMENTS

| | | | |
|---|---|---|---|
| D. 353,445 | 12/1994 | Morad | 4/227 |
| 827,092 | 7/1906 | Freestone | 424/76.3 |
| 1,580,576 | 4/1926 | Weidner | 510/440 X |
| 3,248,740 | 5/1966 | Wisnom | 4/309 |
| 3,824,633 | 7/1974 | Van Vlahakis | 4/309 |
| 4,010,497 | 3/1977 | Menter et al. | 4/309 |
| 4,511,552 | 4/1985 | Cox | 424/76.3 |
| 5,365,616 | 11/1994 | Morad | 4/309 |
| 5,489,415 | 2/1996 | Van Vlahakis et al. | 422/264 |

*Primary Examiner*—Charles E. Phillips
*Attorney, Agent, or Firm*—Reese Taylor

[57] ABSTRACT

A urinal screen having a generally triangular planar configuration includes one or more through openings between its top and bottom surfaces. The screen is composed of a liquid soluble material and includes a deodorant which is released as the screen dissolves. Another embodiment of the invention includes contoured top and bottom surfaces tapering away from the center of the screen and downwardly toward its periphery. The soluble material may also include a fragrance and a detergent. A further embodiment includes a raised locating boss on the bottom surface for cooperation with the urinal drain. Still further, the screen may be packaged in a liquid soluble film.

18 Claims, 4 Drawing Sheets

DISSOLVABLE URINAL SCREEN

RELATED PATENT APPLICATIONS

None.

FIELD OF THE INVENTION

This invention relates in general to urinal screens and relates in particular to a dissolvable urinal screen of unitary construction capable of performing two functions necessary in restroom usage: screening to prevent clogging of the urinal drain and deodorizing and sanitizing to reduce the prevalence of objectionable odors.

BACKGROUND OF THE INVENTION

It is well known in the janitorial field that, in maintaining restroom urinals, two common problems are encountered. On the one hand, it is obvious that it is desirable for sanitary and ambiance purposes to provide a means for deodorizing and sanitizing the urinals and toilets. It is also obviously desirable to prevent the plugging or blocking of the drains of the urinals through the introduction of foreign objects.

In the past, there have been a number of efforts to achieve these goals. The most common approach is to simply deposit a block of a dissolvable chemical composition into the bottom of the urinal and rely upon its dissolvable characteristics to gradually release deodorizing and sanitizing chemicals and odors into the atmosphere and the urinal itself. Another related approach has been to suspend a similar block on the edge of the urinal by means of a wire or plastic hanger. Obviously, the simple use of blocks of this type, while hopefully effectively performing the deodorizing and sanitizing function, does not accomplish the screening function in any significant way and also, in the case of the wire or plastic hanger, requires personal handling by maintenance personnel when the block has dissolved and needs to be replaced.

Further developments have included the provision of plastic, rubber or metal screens in various forms which are placed in the urinal so as to overlie the drain and complemented either with or without the addition of a dissolvable deodorant block placed on top of the screen. The difficulty with this approach is that one must replace the block after it dissolves but, more importantly, one must periodically remove the screen and either clean it or throw it away and replace it with a new screen. It has been found that maintenance workers are often reluctant to do this and, therefore, often neglect to do it so that, while the foreign material is prevented from clogging the drain, the resulting accumulation is unsightly and ineffective.

The basic concepts and approaches just mentioned as well as embellishments thereon can be found in the patent prior art. For example, Freestone U.S. Pat. No. 827,092 discloses a disinfecting and deodorizing block for use in various environments and wherein the block is perforated so as to equally distribute the surface of the block acted upon by the urine or other liquid and increase that surface to enhance release of the disinfectant and deodorant. Patents such as Van Vlahakis U.S. Pat. No. 5,489,415 show a combination of a urinal block, comprised of fluid-soluble chemical components, and a disposable, flanged dispenser which provides a retention cup for the block to position the block out of normal contact with the urine or other liquid. Van Vlahakis U.S. Pat. No. 3,824,633 discloses a similar combination and in both cases, once the block is expended, the entire combination is removed and discarded.

Menter U.S. Pat. No. 4,010,497 discloses a coated paper product not necessarily designed for urinal use, but for use in a commode in which a biodegradable paper is impregnated with a biocidal or germicidal material and is slotted to eliminate splash in the commode water while ultimately dissolving and accomplishing the sanitizing function.

Wisnom U.S. Pat. No. 3,248,740 discloses a foraminous urinal screen in which a lattice-like grid is provided and dipped in a hardenable solution of deodorant which stiffens the grid. The grid then can be deposited in the urinal and this permits the deodorant to gradually evaporate so that, after a given length of time, it will no longer be present within the screen. The screen can then presumably be removed from the urinal and discarded.

While all of these concepts and structures may be presumed to be effective for the purposes for which they were intended, it is believed that a still further improvement can be achieved by providing a dissolvable urinal screen in which a single unitary member is designed to accomplish both the screening and the sanitizing and deodorizing functions and which never requires any retrieval of the used screen or disposal of any remnants of the device.

SUMMARY OF THE INVENTION

It is, accordingly, a principal object of this invention to provide a dissolvable urinal screen which is comprised of dissolvable material and which is configured so as to effectively cover the drain outlet of the urinal, which is perforated so as to permit the urine to pass through it, and which is compounded so as to be totally dissolvable over a predetermined period of time, whereby the urinal screen, once deposited into the urinal, requires no maintenance or subsequent removal, yet effectively performs both the screening, sanitizing and deodorizing functions desirable in this environment.

It is a further object of this invention to package the unitary urinal screen in a water soluble film so as to protect the screen during storage, shipping and handling without impairing its functional characteristics in use.

Accordingly, production of a dissolvable urinal screen of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
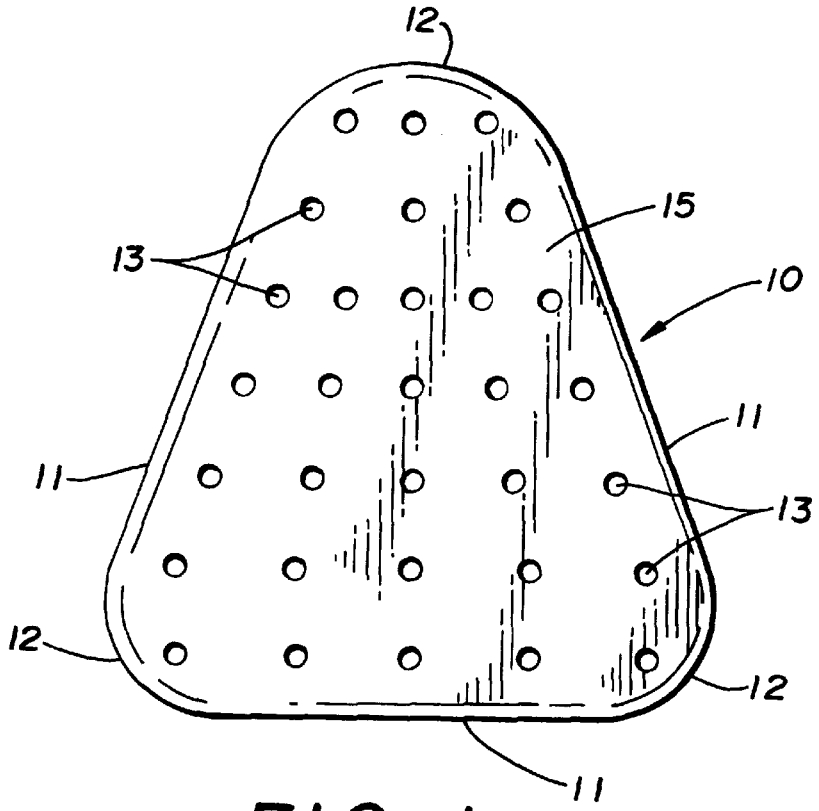
FIG. 1 is a plan view of the dissolvable urinal screen of the present invention.
Figure 2:
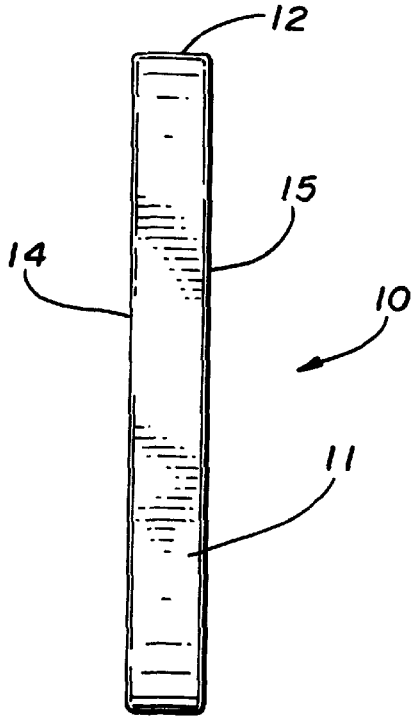
FIG. 2 is a side elevational view of the dissolvable urinal screen of the present invention.

Referring first to FIG. 1 of the drawings, it will be seen that one form of the urinal screen, generally designated by the numeral 10, consists of a block of material having a generally triangular configuration when viewed in plan and having three side edges 11 intersecting at radiused corners 12.

This planar configuration is such that, when placed in the bottom of a typical urinal, the main body of block 10 will overlie the drain and rest on the bottom surface of the urinal so as to permit urine and flushing liquid to enter the drain while preventing large solid articles, such as, for example, cigarette butts, from entering the drain. In that regard, typically the bottom of the urinal is slightly concave for drainage purposes so that the edges of the screen will rest on the bottom wall and be slightly spaced from the drain opening itself.

A plurality of through perforations 13 are provided in the body of the dissolvable urinal screen 10 disclosed herein, extending from the top surface 14 to the bottom surface 15 thereof to permit urine to pass through and to minimize splash. The number of perforations is a matter of choice and either more or less than the number shown in the drawings may be provided. The block 10 which comprises the screen is compounded of a particular composition of chemicals which may include both detergents and fragrances and odor counteractants such that, upon contact with the stream of urine and the flushing liquids, a slow, controlled dissolution of the screen 10 will occur, resulting in the release of the fragrance, detergent and odor counteractant. A particular composition of the block of material will be described below.

The perforations 13, of course, permit the urine to pass through the screen and into the drain and also increase the areas of the screen contacted by the urine and flushing liquids to facilitate the dissolvability of the same.

Figure 3:
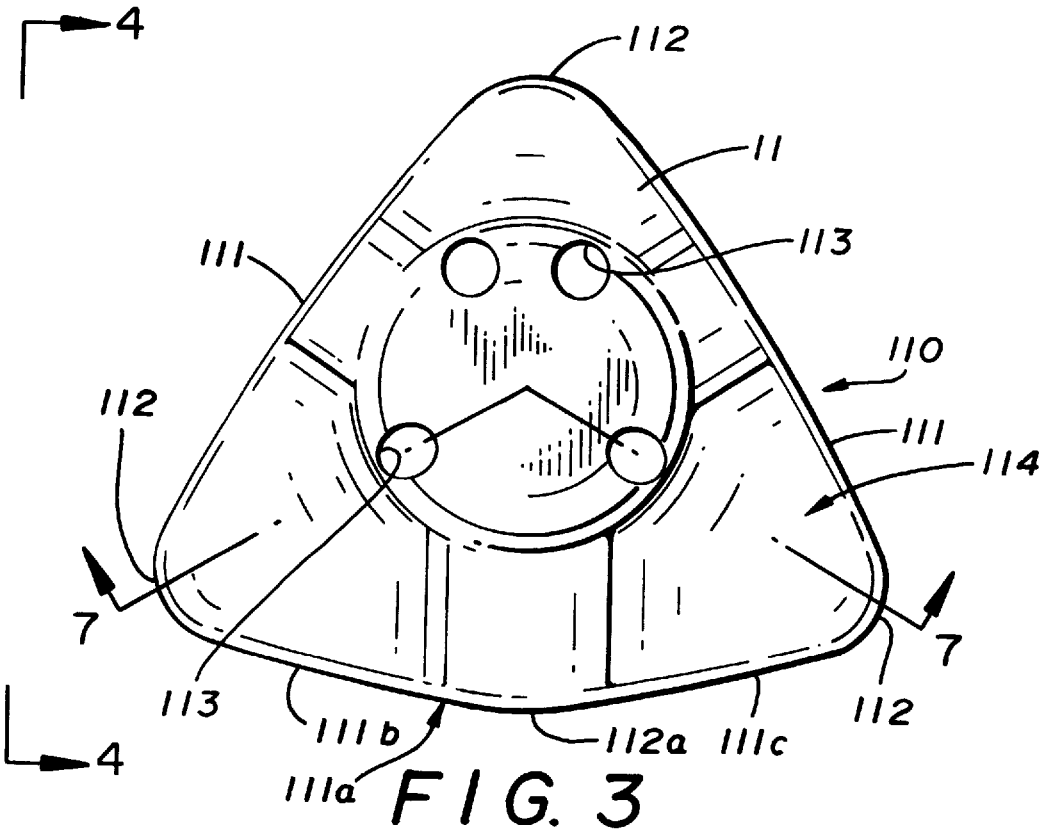
FIG. 3 is a bottom plan view of a further embodiment of the dissolvable urinal screen of the present invention.
Figure 5:
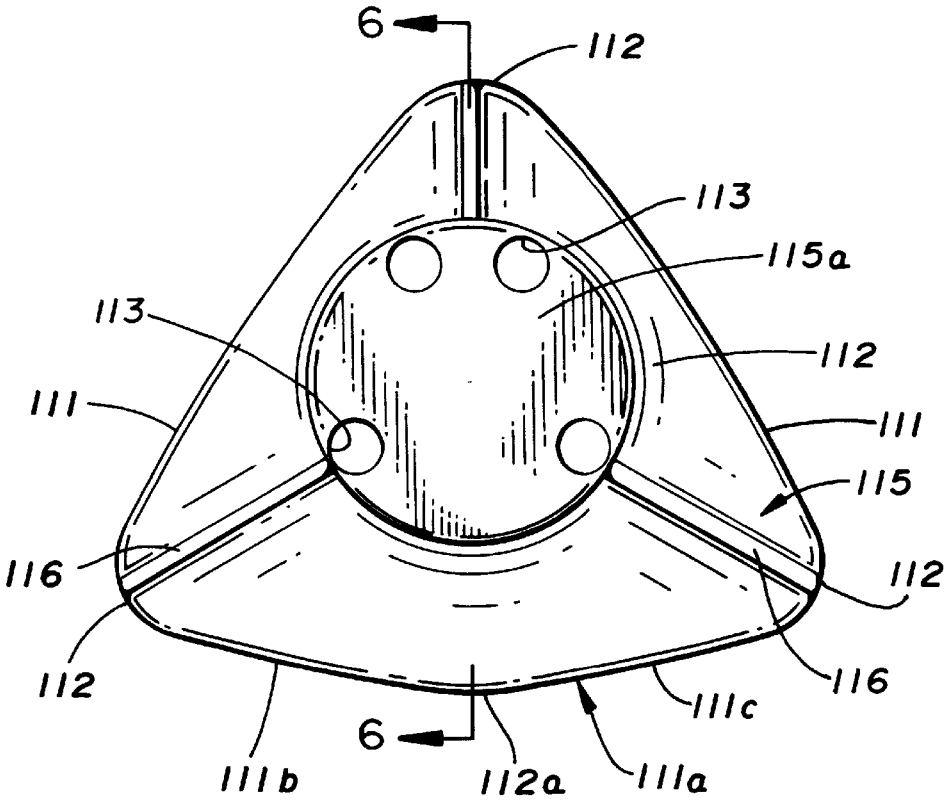
FIG. 5 is a top plan view of the dissolvable urinal screen of FIG. 3.
Figure 6:
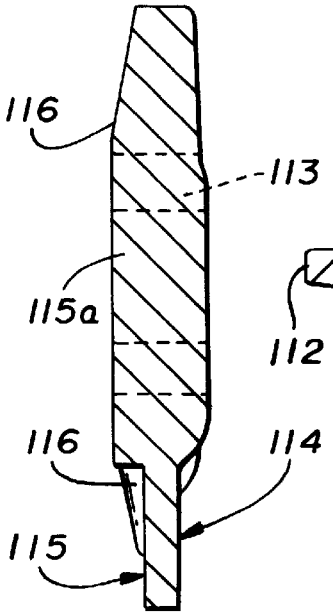
FIG. 6 is a sectional view taken along the line 6—6 of FIG. 5.
Figure 7:
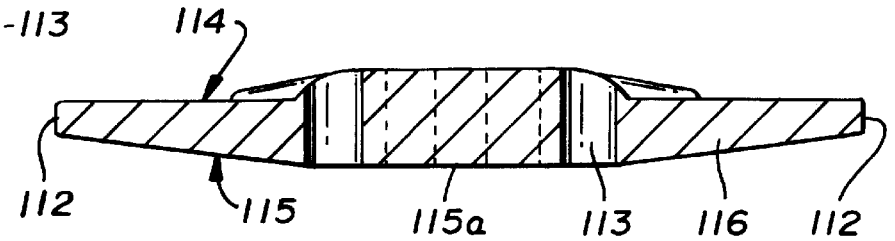
FIG. 7 is a sectional view taken along the line 7—7 of FIG. 3.

Turning then to FIGS. 3 and 5 for a description of a further embodiment of the invention, it will be noted that, again, a substantially generally triangular-shaped block indicated by the numeral 110 is disclosed with edges 111, joined by radiused areas 112, and that a plurality of perforations 113 are present in the central portion of the block. In this form of the invention, each edge 111 is slightly radiused and one edge 111*a* may be said to comprise two segments 111*b* and 111*c* joined by a further radiused area 112*a*.

This configuration again permits the general covering of the area in the basin of the urinal adjacent the drain so as to prevent the entrance of foreign material, such as cigarette butts, chewing gum, etc., into the drain.

Figure 4:
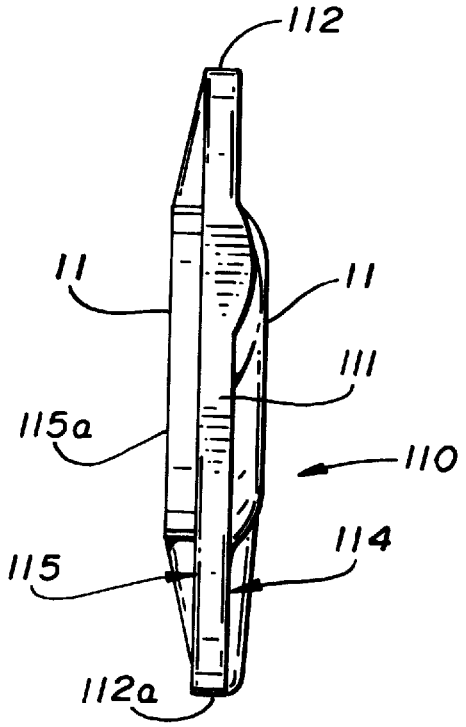
FIG. 4 is a side elevational view of the embodiment of FIG. 3 taken along the line 4—4 of FIG. 3.

In this form of the invention, it will also be noted that, as shown in FIGS. 3 and 4 of the drawings, central areas at the top and bottom surfaces 114 and 115 of the body are substantially raised at the center and taper downwardly toward the edges. On the bottom surface 115 of the block, as shown in FIG. 4 of the drawings, a roughly circular boss or locating protuberance 115*a* may be provided. It is contemplated that when this embodiment of the block is placed in the bottom of the basin of the urinal, this boss will generally engage the drain area and serve to locate the block centrally in the urinal.

As noted also, the body bulges in its central area away from both the top and bottom surfaces or with respect to the central plane of the block, thereby providing surfaces which taper downwardly and away from the central area, thus permitting the urine or other liquid to flow down the top surface 114 and around the edges 111 into the drain. Bottom surface 115 may also have one or more ribs 116 extending downward and outwardly toward the edges as shown in FIG. 5.

A typical urinal screen of either embodiment may be prepared from any desired fluid-soluble chemical composition suitable for the required use thereof. Specifically, the screen should have sufficient strength and rigidity for easy handling, shipping, storage and insertion into the urinal, but dissolve at an acceptable rate so as to have a useful service life of an extended duration. Typically, the screen should weigh between 100 and 300 grams and have a useful service life of at least thirty, and preferably sixty, days. Also, the composition should be capable of reducing the prevalence of objectionable odors as well as perform its intended screening function, as discussed hereinabove. It will be understood that essentially any fluid-soluble chemical composition having the desired properties disclosed hereinabove would be suitable for the present invention. However, a typical urinal block composition may include a binding agent for holding the various ingredients together. Among the preferred binding agents are polyethylene glycol, such as those available under the trade name CARBOWAX PEG 8000 from Union Carbide. Preferably, from about 15% to about 35% by weight, and more preferably from about 20% to about 25% by weight, of the polyethylene glycol may be used in the composition.

The screen composition may also include an extending agent such as sodium sulfate, a detergent such as sodium stearate, and a detergent enhancer such as borax or disodium EDTA. Preferably, from about 10% to about 40% by weight of the composition may be an extending agent, from about 10% to about 45% by weight of the composition may be a detergent, and from about 10% to about 40% by weight of the composition may be a detergent enhancer. More preferably, from about 20% to about 30% by weight of the sodium sulfate may be included in the composition, while from about 25% to about 30% by weight of the sodium stearate may be included in the composition. Borax or disodium EDTA may also be included at a rate of about 10% to about 25% by weight.

It will be appreciated that the detergent and the detergent enhancer basically aid in the cleansing of the urinal.

Additionally, additives may also be included in the composition of the present invention. Specifically, a color or dye may be added to enhance the physical appearance of the product or to color-code the product. Preferably, the dye or coloring agent should be water-soluble and have a suitable color adhesion which is stable in the environment where it will be used.

In addition, any fragrance, perfume, or other odor-inhibiting oils may be included in the composition. One particularly effective, chemical oxidizing agent odor counteractant for the present invention is MCC-100 available from National Research Laboratory of Cincinnati, Ohio.

It will also be understood that other ingredients, such as anti-bacterial agents, anti-microbial agents, various surfactants, disinfectants, and other product-enhancing additives, may be included in the composition to provide an effective screen.

In order to demonstrate practice of the present invention, the following representative chemical formulation was prepared and a block screen according to the concepts of the present invention was designed.

TABLE I

| Block Screen Formulation | | | |
|---|---|---|---|
| Ingredients | Percent By Weights | Percent By Weights | Percent By Weights |
| Carbowax PEG 8000 | 20 | 25 | 25 |
| Sodium Sulfate | 25 | 20 | 30 |
| Sodium Stearate | 30 | 25 | 30 |
| Borax | 20 | 25 | 10 |
| Color | 2.5 | 2.5 | 2.5 |
| Fragrance | 2 | 2 | 2 |
| Odor Counteractant | 0.5 | 0.5 | 0.5 |

Generally speaking, the ingredients were added to a ribbon blender and mixed thoroughly until the mixture was considered homogenous. The resultant mixture was then poured into an extruder having a 175° C. barrel rotating at 25 rpms and extruded at a temperature of about 170° C. The resulting product was then cut to predetermined lengths. These pieces are then transferred to a mold where they are molded to impart the desired surface configuration. Finally, the desired number of perforations were made.

The resultant products were tested and found to have sufficient strength and rigidity as well as an operative service life of extended duration suitable for use as a urinal screen. It should also be noted here that, while a specific formula has been disclosed which produces a fairly rigid screen, it is within the scope of this invention to produce a gel-like screen. It is contemplated that such a screen would have sufficient firmness for easy handling and placement in the urinal while being resistant to damage during shipping and handling.

Figure 8:
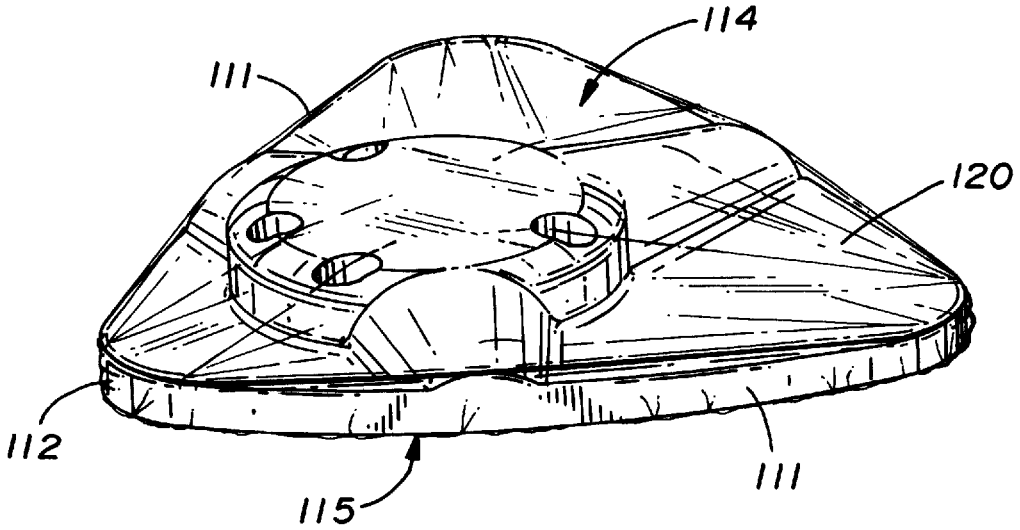
FIG. 8 is a perspective view of the dissolvable urinal screen of FIGS. 3 through 7 showing the screen wrapped in a water-soluble film.

In both the embodiments of the invention illustrated herein, it is further contemplated that the screen could be packaged in a water soluble film 120, as shown in FIG. 8, which will serve to protect the screen during storage, shipping and handling so that, in the event of damage, the odor counteractant and fragrance do not dissipate into the atmosphere or the larger package in which a plurality of screens may be shipped or stored.

While a full and complete description of the invention has been set forth in accordance with the dictates of the patent statutes, it should be understood that modifications can be resorted to without departing from the spirit hereof or the scope of the appended claims.

Thus, while the planar configuration of the screens disclosed and illustrated herein have what has been described as a generally triangular configuration, the invention is not intended to be necessarily limited to that specific configuration and variants thereof may also be employed.

What is claimed is:

1. A screen for urinals having a bottom wall with a drain opening centrally disposed therein, comprising:

a) a block of material dimensioned to rest on the bottom wall of the urinal and overlie the drain opening thereof, said material being dissolvable when contacted by urine so as to release at least one of a deodorant and a sanitizing agent;

b) said block of material having a plurality of through openings therein functioning as a screen to restrain passage of foreign matter, and c) said block of material having top and bottom surfaces, having contoured areas to enhance passage of urine.

2. The screen of claim 1 wherein said top and bottom surfaces generally taper downwardly from a high point adjacent the center of said surfaces toward the periphery of said block of dissolvable material.

3. The screen of claim 2 wherein said bottom surface includes elongate raised ribs extending away from the center of said surface toward the periphery thereof.

4. The screen of claim 1 wherein said bottom surface includes a raised locating boss substantially centrally disposed thereon.

5. The screen of claim 1 further including a packaging material enveloping said block of dissolvable material; said packaging material being liquid soluble.

6. The screen of claim 1 wherein said screen is comprised of flexible material.

7. The screen of claim 1 wherein said block of material has a plurality of through openings therein.

8. The screen of claim 1 wherein said block of dissolvable material is generally triangular in plan.

9. The screen of claim 1 or 8 wherein said dissolvable material includes an odor counteractant releasable upon dissolving of said block of dissolvable material.

10. The screen of claim 9 wherein the amount of odor counteractant is from about 10 to about 40 percent by weight.

11. The screen of claim 1 or 8 wherein said dissolvable material includes a fragrance.

12. The screen of claim 11 wherein said dissolvable material includes a detergent enhancer.

13. The screen of claim 11 wherein the amount of detergent is from about 10 to about 45 percent by weight.

14. The screen of claim 1 or 8 wherein said dissolvable material includes a detergent releasable upon dissolving of said block of dissolvable material.

15. The screen of claim 14 wherein the amount of detergent enhancer is from about 10 to about 40 percent by weight.

16. The screen of claim 1 or 8 wherein said dissolvable material includes a detergent, a fragrance and an odor counteractant.

17. The screen of claim 15 wherein the amount of detergent is from about 10 to about 40 percent by weight and the amount of odor counteractant is from about 10 to about 45 percent by weight.

18. The screen of claim 8 wherein said block of dissolvable material includes first and second elongate edges, each having first and second ends; said first ends being interconnected by a radiused portion; a third elongate edge comprising first and second elongate segments, each having first and second ends; said first ends of said segments being interconnected with each other by a radiused portion; and said second ends of said segments being interconnected to said second ends of said first and second elongate edges by radiused portions.

* * * * *